United States Patent [19]

Castro

[11] 4,359,185

[45] Nov. 16, 1982

[54] MAILBOX

[76] Inventor: Geoffrey Castro, 1339 Crossfield, Katy, Tex. 77450

[21] Appl. No.: 184,291

[22] Filed: Sep. 5, 1980

[51] Int. Cl.[3] ..... B65D 91/00

[52] U.S. Cl. ..... 232/17; D21/114; D99/30; 232/33

[58] Field of Search ..... 232/17, 38, 39; D99/29, D99/30, 32, 33

[56] References Cited

U.S. PATENT DOCUMENTS

| | | | |
|---|---|---|---|
| D. 158,282 | 4/1950 | Keeler | D99/30 |
| D. 166,749 | 5/1952 | Heinz | D99/30 |
| D. 252,293 | 7/1979 | Gordon, Sr. | D21/114 |
| 992,605 | 5/1911 | Schroeder | 232/33 |
| 1,166,472 | 1/1916 | Neidermeyer | 232/33 |
| 1,430,307 | 9/1922 | Halley | 232/33 |
| 1,636,329 | 7/1927 | Sherry | 232/33 |
| 2,068,275 | 1/1937 | Luss | 232/33 |
| 2,430,916 | 11/1947 | Crossett | 232/33 |

*Primary Examiner*—James T. McCall
*Assistant Examiner*—Peter A. Aschenbrenner
*Attorney, Agent, or Firm*—Clarkson & Cohn

[57] ABSTRACT

A mailbox of ornamental design of architectural nature, specifically colonial, having design components of functional utility such as translucent windows, a roof and door which isolates the ambient environment from mail contained inside the mailbox, a pouch for receiving mail, the mailbox capacity extending from normal size letters to large packages, the exterior design to be personalized in accordance with the users personal preferences.

1 Claim, 3 Drawing Figures

FIGURE 1
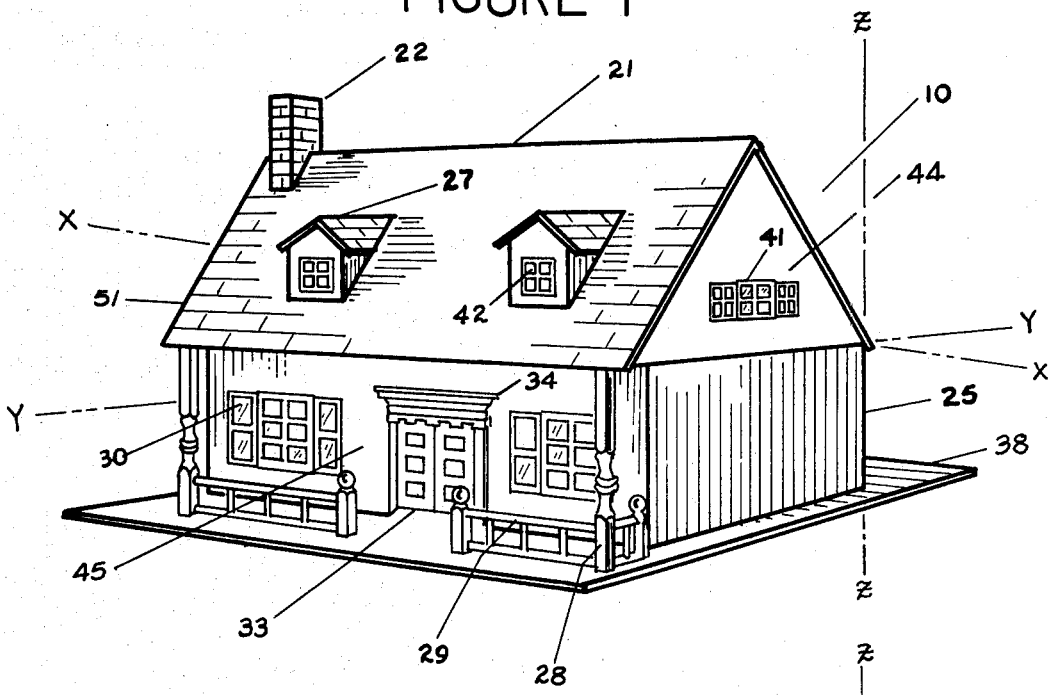
FIGURE 2
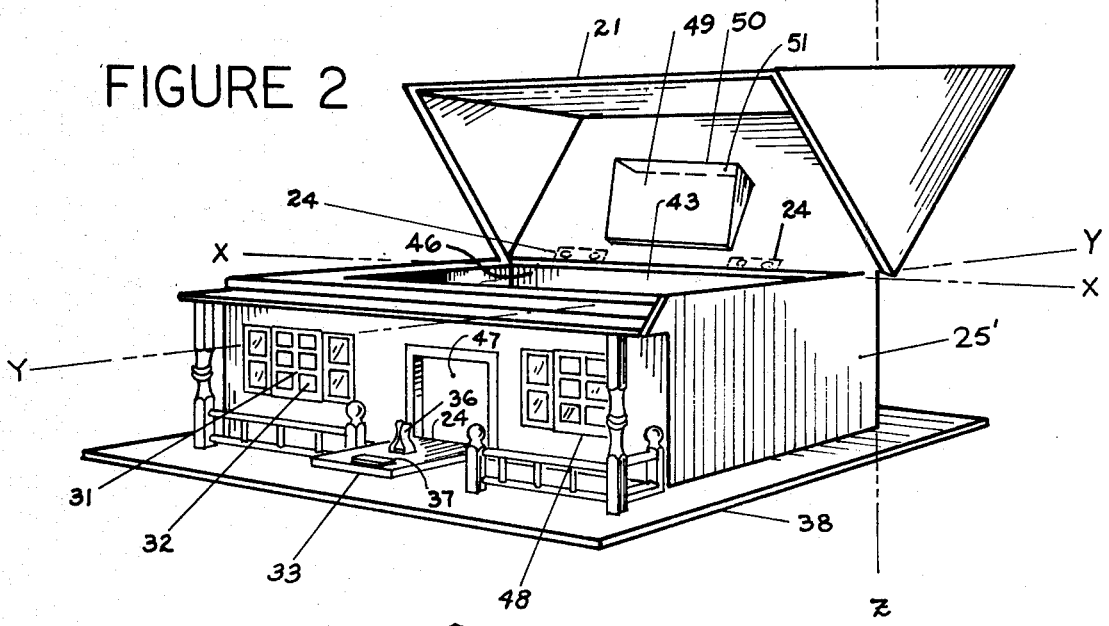
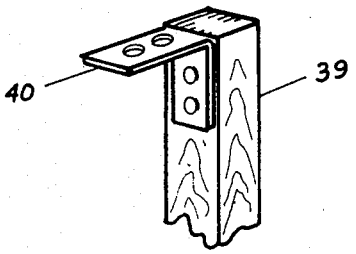
FIGURE 3

MAILBOX

CROSS REFERENCES TO RELATED APPLICATIONS

There are no related applications nor cross references thereto.

FEDERALLY SPONSORED RESEARCH AND DEVELOPMENT

There are no rights under Federally sponsored research and development programs.

BACKGROUND OF THE INVENTION

1. Field of the Invention

The field of the invention is in the mailbox manufacturing field for individual residences.

2. Description of the Prior Art

The prior art consists of thin metallically constructed mail boxes which have means of accepting letters and small packages. The prior art was not designed to be of aesthetic design and appearance and were not of ornamental but only functional design and therefore did not enhance the view of residential subdivisions.

In the prior art only one (1) means of entry were possible thus requiring a delivery person to open large entry means for the smallest of deliveries. In the invention, the delivery person has a choice depending on the size of the delivered item. Specifically a door which has a clip and holding means can be opened to insert a letter or the like and if the delivery is a large package, the roof can be pivoted thus exposing the compartment which can accept large deliveries.

SUMMARY OF THE INVENTION

A mailbox is depicted which is of personalized design in the form of a colonial style house. The components which are of house type design are of utilitarian use. Even though decorative in appearance useful functions are obtained. The roof acts as protective covering for deposited mail or parcels. The windows are translucent allowing the delivery person to see if there is outgoing mail and allows the resident to view whether there has been a delivery.

The compartment area of the mailbox is accessable either thru the door by opening it or thru the roof by pivoting the roof on its hinges. The name of the resident is subscribed to the interior side of the door and the interior surface of the roof; therefore, privacy of the resident's name is maintained. The door has a clipping feature which allows ingoing and outgoing mail to be clipped to it for ease of handling and magnetic holding means.

Outgoing mail can be either clipped to the door or inserted in the opening of a pouch which is located on the interior of said roof.

BRIEF DESCRIPTION OF THE DRAWINGS

FIG. 1 is a perspective view of the mailbox shown in the closed position.

FIG. 2 is a perspective view of the mailbox shown in the open position.

FIG. 3 is a perspective view of typical mounting means for the mailbox.

In FIG. 1, a perspective view of mailbox 10 is shown. Base 38 supports said mailbox and is adaptable to be structurally connected to post 39 utilizing bracket 40 as shown in FIG. 3. The mailbox is shown closed and provides a seal from ambient conditions. All decorative means including chimney 22, roof 21, dormer window 42, dormer 27, attic window 41, shingles 51, shutter 30, door handle 34, door 33, rail 29, and column 28, front window 31 and translucent pane 32, segregate any mail or packages contained in said mailbox from the ambient conditions. Depending on the customization of said mailbox to the individual preferences of the user, some or all of the referenced amenities may be used.

Roof 21 is opened by grasping the roof itself and either picking up said roof or causing it to pivot about either the X—X axis, or Y—Y axis as shown in FIG. 2. Said roof is of high pitched appearance such as a typical colonial home having chimney 22, dormer(s) 27, dormer window(s) 42, attic window(s) 41, and attic siding 44. Said attic window(s) and said dormer window(s) are translucent.

Said roof is positioned above and supported by shell 25, said shell consisting of two (2) each side wall 25', front wall 45, and rear wall 46 (shown in FIG. 2). Said front wall has door cutout 47 and two (2) each of window cutout 48 each capable of accepting decorative means which may consist of said door or said window.

In FIG. 2 rail 29 and two (2) each of column 28 are mounted to base 38 and provide additional support for said roof or support outgoing mail which may be placed outside of said mailbox prior to being picked up by the postal service. Large packages are delivered and deposited in compartment 46. Pouch 50, having opening 51, is attached to the interior of said roof.

In FIG. 2, the said roof is shown in the open position thusly for acceptance of a large volume of mail or packages. Said roof is hinged utilizing several of hinges 24 mounted along the X—X axis.

Door 33 is shown in the open position having been pivotally mounted utilizing hinge 24 (not shown), having magnetic holding means 37 and clip 36. Door handle 34 is shown in FIG. 1; it being mounted on top of said door.

In FIG. 3, post 39 and bracket 40 are shown, both said items attachably mounting said mailbox to the ground. The mailbox can be secured with other mounting means.

DESCRIPTION OF THE PREFERRED EMBODIMENT

The preferred embodiment is shown as drawn on the Figures. It is of colonial architectural design although the type of architectural design can be left up the personal direction of the owner of the mailbox. The hinged roof, translucent windows, door with clips and holding means, base and columns can all be utilized with alternate house designs such as French, modern, traditional, contemporary, and the like. Either of the foregoing type designs would have the features as disclosed herein.

In the drawings and specification, there have been set forth several embodiments of the invention and, although specific terms are employed, they are used in a generic and descriptive sense and not for purposes of limitation.

That which I claim is:

1. A mailbox, adaptable for use to contain packages of various sizes and to contain correspondance and the like, of personalized ornamental yet functional design patterned after colonial architecture or other architectural designs such as French, modern, traditional, contemporary, and the like, comprising;

a compartment capable of containing correspondance and packages, said compartment being isolated from the ambient surroundings, a roof hinged to expose said compartment to the delivery person or homeowner, said roof providing a positive seal against said ambient surroundings, said roof having decorative means such as the chimney, and two (2) dormers, and shingles, a pouch with an opening, attached to the interior of said roof, capable of supporting outgoing mail of larger than ordinary size, a shell supporting said roof, said shell having two (2) side walls, a rear wall, and front wall, said front wall having decorative means such as the door, and two (2) windows, having translucent characteristics, a door having a clip and magnetic holding means, said door being hinged to open and close, two (2) columns in which mail can be wedged between said front wall and said rails, and a base to support said mailbox, said base being mountable to a mounting means.

* * * * *